US010415787B2

(12) United States Patent
Lessard et al.

(10) Patent No.: US 10,415,787 B2
(45) Date of Patent: Sep. 17, 2019

(54) VEHICLE LED LAMP HAVING RECIRCULATING AIR CHANNELS

(71) Applicants: Jason Lessard, Bow, NH (US); Blair Weiss, Peterborough, NH (US); Richard Holland, Stoddard, NH (US)

(72) Inventors: Jason Lessard, Bow, NH (US); Blair Weiss, Peterborough, NH (US); Richard Holland, Stoddard, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 15/868,467

(22) Filed: Jan. 11, 2018

(65) Prior Publication Data

US 2019/0211991 A1 Jul. 11, 2019

(51) Int. Cl.

| | |
|---|---|
| ***F21S 45/43*** | (2018.01) |
| ***F21S 41/141*** | (2018.01) |
| ***F21S 45/33*** | (2018.01) |
| ***F21S 45/20*** | (2018.01) |
| ***F21S 45/49*** | (2018.01) |

(52) U.S. Cl.

CPC ..... *F21S 45/43* (2018.01); *F21S 41/141* (2018.01); *F21S 45/20* (2018.01); *F21S 45/33* (2018.01); *F21S 45/49* (2018.01)

(58) Field of Classification Search

CPC .. F21S 45/43; F21S 45/20; F21S 45/33; F21S 45/49; F21S 41/141

See application file for complete search history.

(56) References Cited

U.S. PATENT DOCUMENTS 3,486,019 A * 12/1969 Bryant ..... F21S 41/192 362/548
5,138,541 A * 8/1992 Kano ..... F21V 9/04 362/293

(Continued)

FOREIGN PATENT DOCUMENTS

WO 2016008738 A1 1/2016

OTHER PUBLICATIONS

LED headlamp understood to be offered under "Oslamp" trade name on eBay website of 72 Watt, type H11 LED conversion bulb, marked "2016BB" in first figure of set of 5 partially annotated color figures, depicted under the legend "2017 New Arrival" (believed originating from a company in Guangzhou, China), located on website www.ebay.com (5 pgs., color). Discussed in present specification at para. [0008].

*Primary Examiner* — Julie A Bannan
(74) *Attorney, Agent, or Firm* — Edward S. Podszus

(57) ABSTRACT

Lamp module 32 contains solid-state light source 17 and has mounting flange 42 coupleable to headlamp reflector 12. Lamp module 32 has base 2 defining central post 4, post 4 defining internal first air passage 401. Base and post act are heat sinks. Fan 8 is disposed within base 2. Circuit board 14 having LED arrays 17 is mounted inside post 4 in fluid communication with first air passage 401. Base 2 defines second air flow passage 405 exterior of post 4, second air passage 405 being oriented to direct air past mounting flange 42. Base 2 further defines third air passage 410 rearward of mounting flange 42 and radially outward from second air passage 405. Mounting flange 42 may be keys coupleable to slots 15. A method of directing an air stream through slots 15 in reflector socket 121 is described.

14 Claims, 11 Drawing Sheets

(56) References Cited

U.S. PATENT DOCUMENTS 5,311,395 A 5/1994 McGaha et al.
5,618,097 A 4/1997 Coushaine
5,855,430 A 1/1999 Coushaine et al.
6,080,019 A 6/2000 Coushaine
6,227,686 B1 * 5/2001 Takahashi ..... F21V 25/02 362/345
6,497,507 B1 * 12/2002 Weber ..... F21S 45/43 362/547
6,621,705 B1 9/2003 Ballenger et al.
6,764,211 B2 * 7/2004 Eto ..... F21V 9/08 362/547
7,144,140 B2 * 12/2006 Sun ..... F21K 9/233 362/373
7,261,451 B2 8/2007 Coushaine et al.
7,484,863 B1 * 2/2009 Aubrey ..... F21V 13/04 362/294
7,683,395 B2 3/2010 Huber et al.
7,731,368 B2 * 6/2010 Ghosh ..... G03B 21/16 353/60
7,736,026 B2 * 6/2010 Teichgraeber ..... F21V 29/02 362/294
7,901,110 B2 * 3/2011 Mulay ..... H01J 7/26 313/11
7,923,907 B2 * 4/2011 Tessnow ..... F21K 9/00 313/46
8,066,414 B2 * 11/2011 Pabst ..... F21V 29/677 362/373
8,115,395 B2 * 2/2012 Horng ..... F21V 29/02 315/117
8,118,462 B2 2/2012 Inoue et al.
8,383,946 B2 2/2013 Kim
8,616,714 B2 * 12/2013 Lee ..... F21V 29/713 313/46
8,931,925 B2 * 1/2015 Yang ..... F21V 29/004 362/294
8,974,083 B2 3/2015 Weekamp et al.
9,500,356 B2 * 11/2016 Yang ..... F21V 29/004
10,066,801 B1 * 9/2018 Rice ..... F21S 41/164
2001/0010447 A1 * 8/2001 Yamane ..... H01J 61/0732 313/113
2003/0034737 A1 * 2/2003 Moench ..... H01J 61/52 315/32
2003/0189828 A1 * 10/2003 Coushaine ..... F21V 29/76 362/656
2007/0258237 A1 11/2007 Hohl-AbiChedid et al.
2009/0185381 A1 * 7/2009 Willwohl ..... F21K 9/00 362/294
2010/0027270 A1 * 2/2010 Huang ..... F21V 29/02 362/310
2010/0091486 A1 * 4/2010 Wu ..... F21K 9/00 362/234
2010/0213809 A1 8/2010 Roehl et al.
2012/0049732 A1 * 3/2012 Chuang ..... F21V 29/83 315/32
2014/0328079 A1 * 11/2014 Itagaki ..... F21V 29/02 362/547
2015/0146447 A1 5/2015 Kuepper et al.
2016/0010822 A1 * 1/2016 Hsu ..... F21S 41/19 362/520
2016/0169466 A1 6/2016 Kuepper et al.

* cited by examiner

VEHICLE LED LAMP HAVING RECIRCULATING AIR CHANNELS

CROSS REFERENCE TO RELATED APPLICATIONS

N/A

TECHNICAL FIELD

This disclosure relates to cooling light sources for a vehicle, particularly automotive headlamps having a solid-state or light-emitting diode (LED) light source formed as a replaceable lamp capsule received at a conventional socket of a reflector.

BACKGROUND

While solid state light sources, e.g., light emitting diodes (LEDs) may generate less thermal energy compared to traditional bulbs (e.g., incandescent light bulbs), solid state light sources nevertheless generate thermal energy which should be managed in order to control the junction temperature. A higher junction temperature generally correlates to lower light output, lower luminaire efficiency, and/or reduced life expectancy. Solid-state illumination systems include heat sinks to dissipate thermal energy away from the solid state light source in order to manage the junction temperature.

It is known that solid-state light-emitting diodes (LEDs) are efficient and used in automotive low beam and high beam headlamps. Higher power LEDs are now used in such applications, such as those sold by OSRAM Opto Semiconductors under the trade designation Oslon, and can employ 8 chips to generate 1250 lumens. When using a passive heat sink, such LEDs need relatively large passive heat sinks, which may be heavy and present a lampset packaging concern. Even when using the higher power LEDs and passive heat sinks the radiated heat remains behind the headlamp housing's bezel which conceals the light source and the front lens cover stays relatively cool, too cool for the thermal power of these LEDs to melt ice or defog lenses, as was commonly done by the traditional but less efficient filament incandescent or halogen lamps, such as conventional H11 bulbs for a headlamp, which generated plentiful waste heat. Conventional solutions have involved hot air generating fans with complicated air ducts that required breaking holes into the bezel, undesirable from a standpoint of a vehicle manufacturer's styling goals.

ACKNOWLEDGED PRIOR ART

Conventional headlamp capsules and their twist-and-lock manner of securement to a headlamp reflector are illustrated in U.S. Pat. No. 5,618,097 (Coushaine), U.S. Pat. No. 7,261,451 (Coushaine), and U.S. Pat. No. 5,855,430 (Coushaine) of the present Applicant's assignee, are known, and are each incorporated here in their entirety as if fully set forth herein. Commercial embodiments of such headlamp capsules as seen at Coushaine Pat. '097 at FIGS. 1-3 therein are generally designated in the trade as, for example SAE type 9005 or 9006 capsules (also known as HB3 and HB4, respectively), which are generally L-shaped, and embodiments of FIGS. 6-12 therein (or at Coushaine Pat. '430 at FIG. 4) are generally designated in the trade as, for example SAE type 9008 (or H13), which are generally straight, and which also reflect the mode of latching and sealing of an H11 lamp to a conventional reflector socket. When a conventional lamp capsule of these types is received in a socket positioned in the neck of a headlamp reflector, a sealing gasket, e.g. an O-ring of silicone rubber, provides an environmental seal in or at the neck. The sealing gasket (e.g. O-ring) can also act to position the lamp (e.g. radially position) in the socket of the reflector thus ensuring proper filament position and so thus regulatory photometric performance.

Having reference in the present Background paragraphs to reference numerals and figures (not in boldface) as found in the respective prior patent being referred to, then, referring for example to U.S. Pat. No. 5,855,430 (Coushaine), which is incorporated by reference in its entirety as if fully set forth herein, lamp capsule 32 (see e.g. FIGS. 1-4) includes a base 34 molded of a high temperature plastic and includes a keyed portion having radially extending keys or arms 42. Lamp base 34 also includes a connector portion having contact leads 92 as is known in the art for connection to an electrical power source or plug. The connector portion is of conventional design and may have a right angle ("L-shaped") configuration, or in other embodiments, the connector portion may have a straight configuration and be generally coaxial with the central axis 39 of light source 38 such as the glass bulb containing filaments. Retaining keys 42 extend from lamp capsule 32 and may have the form of radially-extending tabs or projections. Retaining keys 42 are typically molded with lamp base 34 and are located at different circumferential positions around base 34, typically three spaced circumferentially equidistant at 120 degrees, and having a radial orientation feature that one key and its mating slot be larger than the other two keys. The undersides of retaining keys 42 define a mounting surface which acts as a reference plane from which to determine the LCL (Light Center Length) axially to the center of the bulb filament. The retaining keys 42 may also have cam surfaces or axial positioning surfaces 40. As shown in FIGS. 1-2, when capsule 32 is latched into position to reflector 12, the underside of retaining keys 42 comes into abutment with the axial positioning surfaces 22 of reflector 12. The glass lamp bulb 38 is typically mounted on lamp base 34 using a conventional mounting structure, including a metal clamp or holder 36 secured to a press seal portion of the bulb envelope. Electrical connections (not shown) within lamp capsule 38 are made in conventional manner. Disposed axially from retaining keys 42, in this embodiment axially below, there is formed on capsule sealing surface 46 a gasket, O-ring or the like 64 which provides a seal for use with lamp capsule 32 when inserted into a reflector 12. In other embodiments, e.g. as shown in Coushaine U.S. Pat. No. 6,080,019 ("Coushaine Pat. '019") at FIG. 2, a gasket is received axially above the retaining keys in a groove 70.

Referring further to Coushaine Pat. '430 at FIGS. 1-2 and column 3, lines 4-35 therein, reflector 12 forms a neck or socket at retaining wall 20 that receives and retains lamp capsule 32. The socket region has capsule latching structure 24, 26, which provides a ledge onto which capsule retaining keys 42 can be introduced through mating slots such as by axial motion followed by slight rotational motion (so-called "eighth-turn" or "quarter-turn") akin to a bayonet latch, all as is known in the art. This insert, twist and lock mounting itself is conventional in the art. Referring to FIG. 2, reflector 12 forms a socket such that lamp capsule 32 with retaining keys 42 is introduced into the slots on the reflector neck that match the location of respective keys 42. When lamp capsule 32 is inserted into reflector 12, each key 42 passes axially inward sufficiently to slide up on a corresponding lead-in ramp 26 formed on reflector 12. By rotating lamp capsule 32, retaining arms or keys 42 are cammed up the lands, ledges or ramps 26, thereby advancing lamp capsule 32 along optical axis 18 (z-direction) while engaging resilient gasket 64. When thus rotated into position, axial undersurfaces 40 of retaining keys 42 come into abutment with axial positioning surfaces 22. Also, radially directed face 24 can come into register with the face of mating radial locating surface 44 of capsule 32 from which keys 42 extend, for radial positioning within the bore of the reflector neck.

Known further in the art of LED retrofit lamps are Published Appln. US 2010/0213809 (Roehl). Also known is US 2015/0146447 (Kuepper) from which its FIGS. 4-5 and text at paragraphs [0033]-[0035] make clear that there is no air flow from the retrofit lamp 10 to a location behind a reference plane 13 of the reflector into which the lamp is mounted. Further, there is known an LED lamp offered for sale on the website eBay believed to be under the trade designation "Oslamp" 72 Watt, type-H11 LED conversion bulb (believed originating from a Chinese company of Guangzhou, China), understood from the website's annotated photo of a bulb marked "2016 BB" depicted under the legend "2017 New Arrival" that the LED retrofit lamp has a Cree chip-on-board LED disposed on a copper substrate PCB disposed inside an aluminum heat conduction pipe that is centrally located atop a plastic deck which sits atop a finned aluminum cooling housing that contains underneath the housing a cooling fan; it is presently understood from this that the plastic deck does not have an air exit located radially outward of the central heat conduction pipe.

SUMMARY

Embodiments herein provide a lamp module structure that, when mounted in a headlamp reflector and energized, direct a first air flow past the LEDs disposed in the interior of the reflector, a second air flow through the key-receiving slots at the module mounting-plane in the socket of the reflector and also into the interior of the reflector, and a third air flow behind the mounting plane and exterior of the reflector in order to minimize air stagnation at the heat sink.

In one embodiment, an automotive solid-state lamp module adapted to be selectively secured to a reflector having a lamp-receiving socket comprises a base defining a central post having an outer peripheral surface, the post defining an internal first air flow passage in an interior of the post. The base and post act as a heat sink. A fan is disposed in a cavity within the base. A circuit board bearing at least one solid-state light source, e.g. LEDs, or one or more LED arrays, is mounted inside the post in fluid communication with the first air flow passage. The base, in particular the post, is provided with one or more mounting flanges configured to be coupleable to the reflector socket, for example to a conventional twist and lock socket having circumferentially spaced key-receiving slots. The base also defines a second air flow passage exterior of the post, the second air flow passage being oriented to direct air exiting therefrom past the mounting flange. The base further defines a third air flow passage rearward of the mounting flange and radially outward from the second air flow passage. Further embodiments and advantages are discussed hereinbelow.

BRIEF DESCRIPTION OF FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION INCLUDING BEST MODE OF A PREFERRED EMBODIMENT

Figure 1:
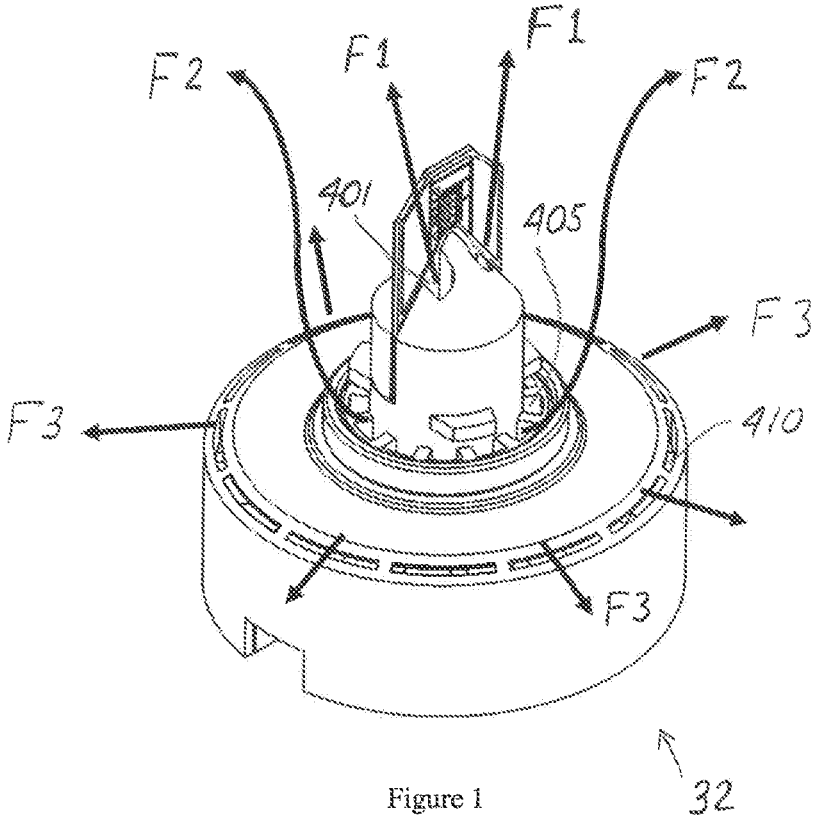
FIG. 1 is a top perspective view of lamp module 32 showing three air flows.

It may be appreciated that the present disclosure is not limited in its application to the details of construction and the arrangement of components set forth in the following description or illustrated in the drawings. The embodiments herein may be capable of being practiced or being carried out in various ways. Also, it may be appreciated that the phraseology and terminology used herein is for the purpose of description and should not be regarded as limiting as such may be understood by one of skill in the art.

The automotive headlamp 6 disclosed herein is suitable for use on a motor vehicle, particularly in the reflector cavity for the vehicle forward lighting such as the vehicle headlamp or fog lamp (collectively be referred to herein as a vehicle headlamp) which is used to illuminate a road surface. The type of motor vehicle may include, but is not limited to, a land vehicle such as a passenger sedan, a sport utility vehicle, a minivan, a truck (light or heavy truck) and a recreational vehicle (e.g., ATV, motorcycle, snowmobile). Alternatively the motor vehicle may also include water vehicles (e.g. boats, jet-skis, personal water craft) and air vehicles (e.g. planes, helicopters).

Figure 4:
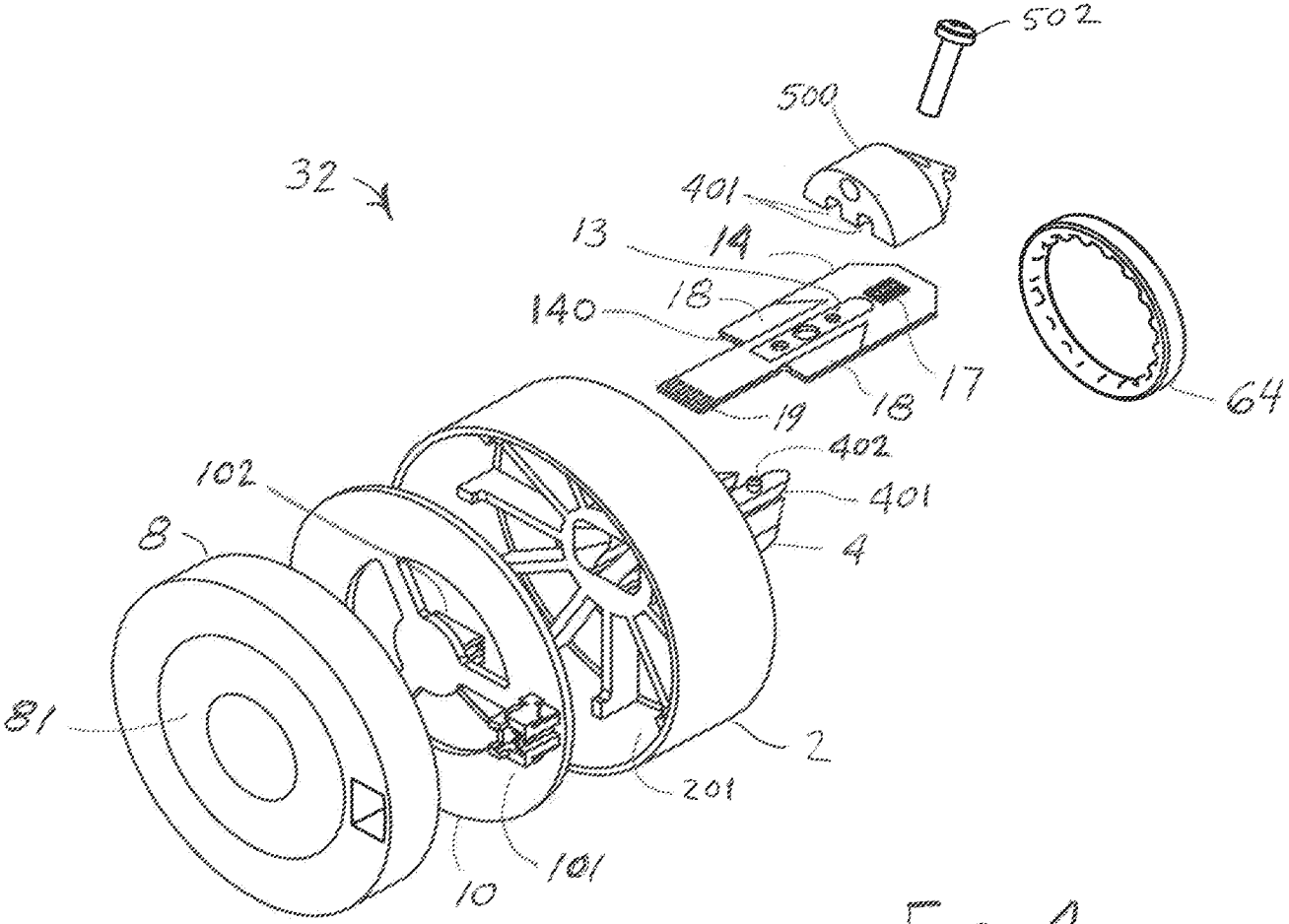
FIG. 4 is a rear exploded perspective view of lamp module 32.
Figure 5:
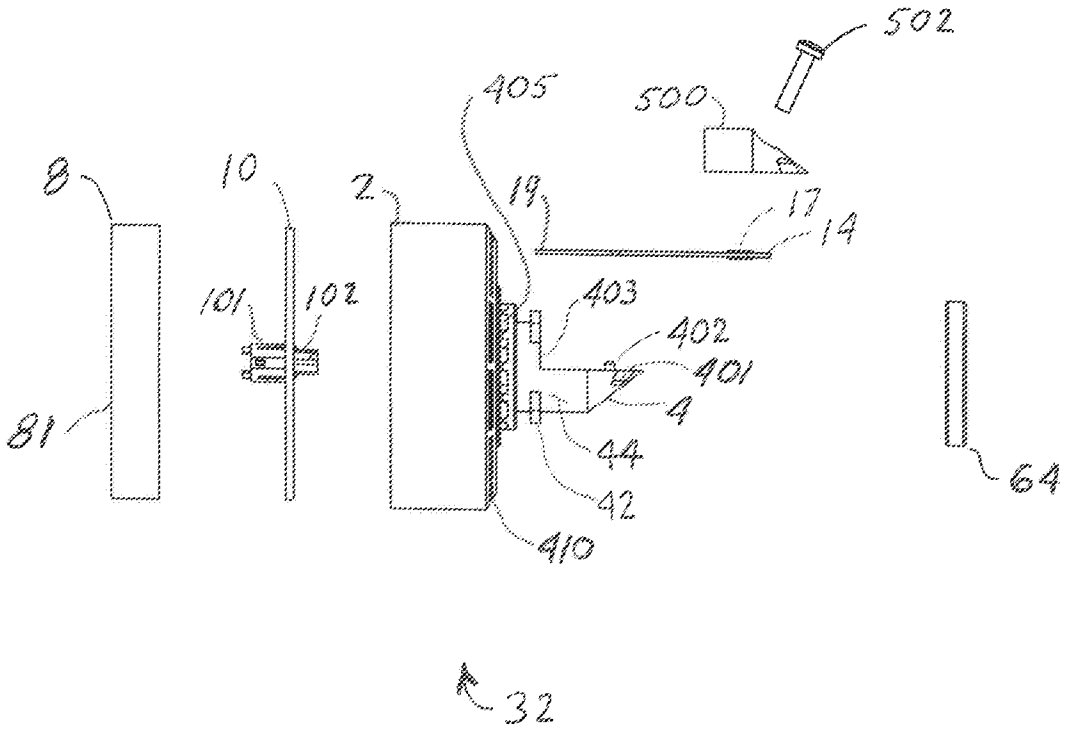
FIG. 5 is a side exploded view of lamp module 32.

Referring to FIGS. 1-5, solid-state lamp module 32 has a housing base 2 formed of thermally conductive material, such as metal, e.g. cast aluminum, in order that base 2 also act as a heat sink. Within base cavity 201 in base 2 is accommodated a fan 8 which, when energized, forces air flow. Also disposed within base 2 is an LED driver circuit board 10 having a drive circuit with suitable electrical connections and traces (not shown) as is known in the art. Driver circuit board 10 is formed with central apertures so air driven by fan 8 passes therethrough into an interior cavity 201 of base 2. Fan 8 may contain a Sunon electric fan, e.g. model MF40101VX-1000U-A99, available from Sunon-wealth Electric Machine Indus. Co., Ltd. (Taiwan) which exhibits a maximum air flow of 9.9 CFM (280 liters/min) at zero static pressure. Fan 8 can be accommodated in base 2 sized to have an overall diameter at its widest of about 60 mm and a depth of base 2 in an axial direction from the rear to the seating surface of gasket 64 of about 24 mm. An air inlet side 81 of fan 8 is seen in FIG. 4 in that air is drawn from an environment external of, and generally axially rearward of, lamp module 32 up into fan 8 and expelled, as seen in FIG. 4, in an axially forward direction, up and into an internal cavity in base 2.

Lamp module 32 is sized to substitute for a conventional halogen incandescent filament H11 lamp into its conventional headlamp reflector 12 whose socket 121 has a neck having three radial slots 15 to receive mounting flanges of the lamp module and retain it by the conventional insert, twist and lock mounting known in the art.

Figure 2:
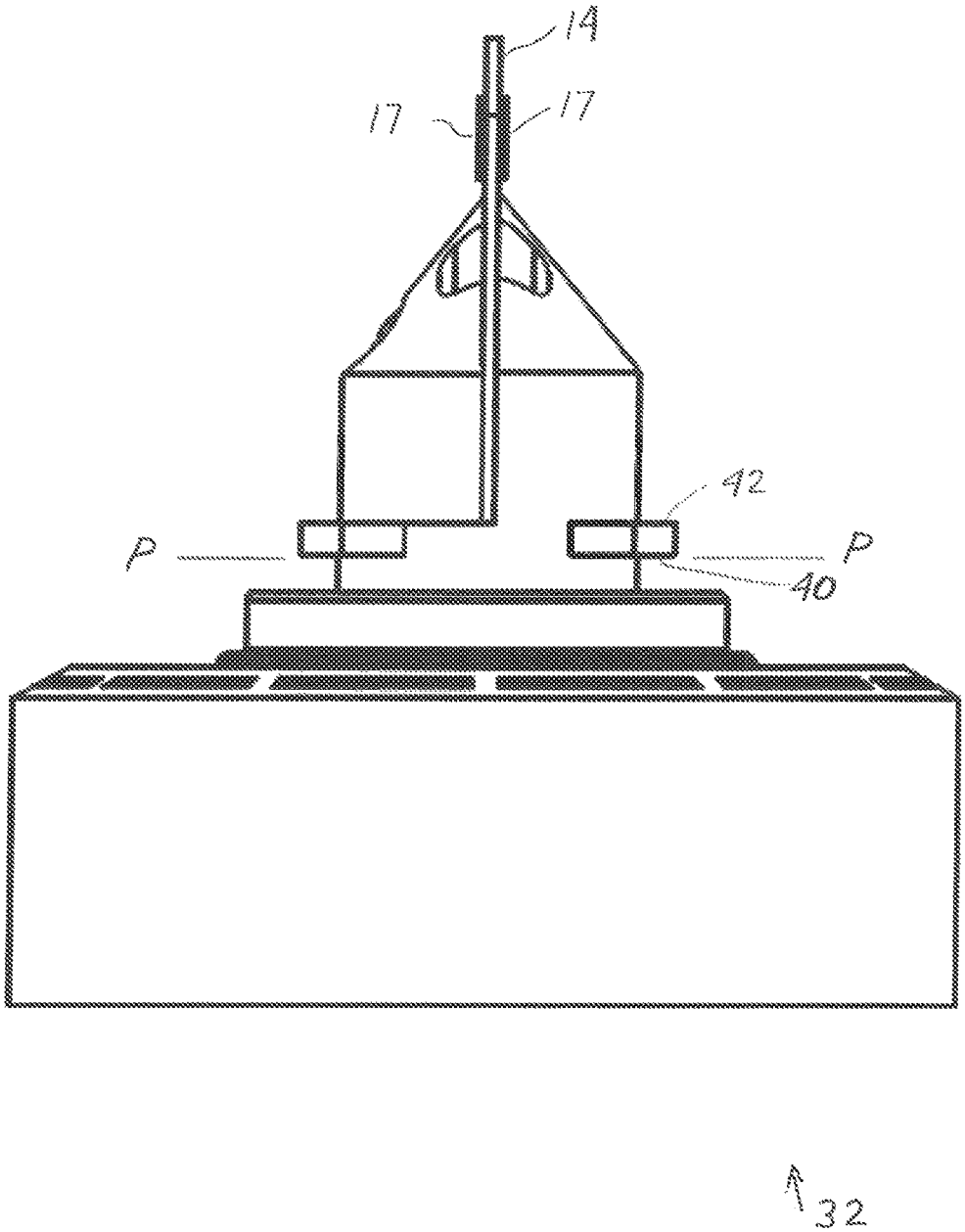
FIG. 2 is a side elevational of lamp module 32.
Figure 3:
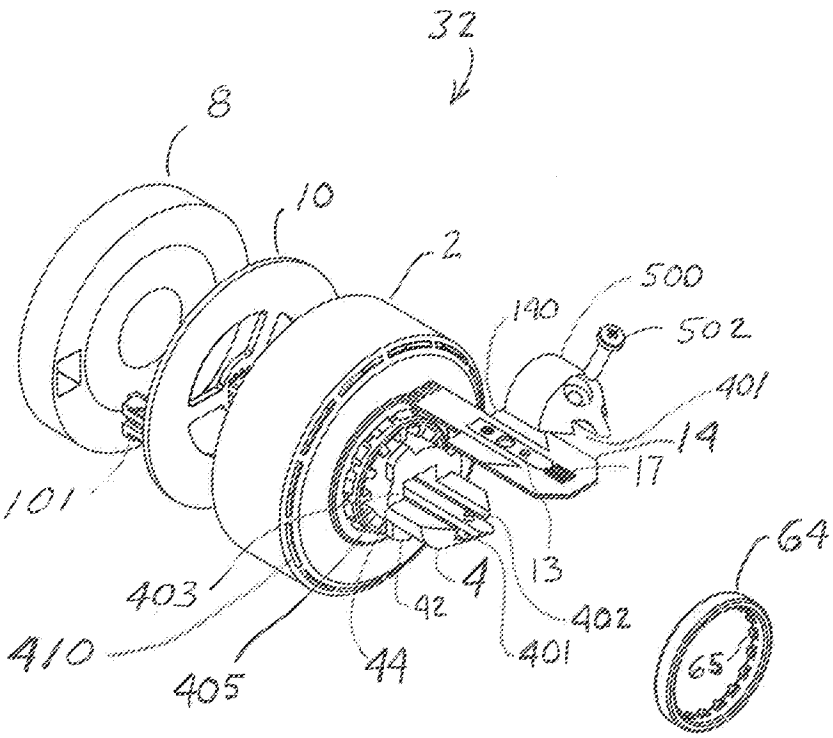
FIG. 3 is a front exploded perspective view of lamp module 32.
Figure 7:
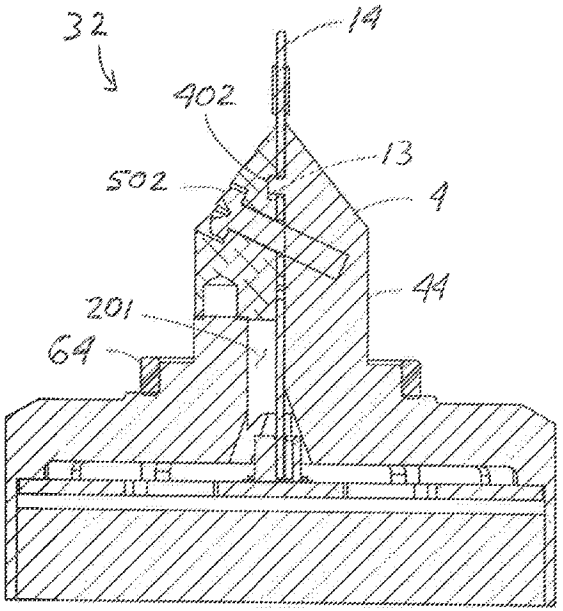
FIG. 7 is a sectional view along B-B of FIG. 6.

The base 2 also receives LED-bearing printed circuit board (PCB) 14. PCB 14 is preferably a metal-core PCB (MCPCB). PCB 14 contains solid-state light sources 17, such as light-emitting diodes (LEDs) 17. A first array of LEDs 17, e.g. a 1×4 array, is connected on the first side of PCB 14 and a second similar array of LEDs 17 on the opposite side of PCB 14. The two arrays of LEDs 17 are arranged back-to-back. The overall width dimension of the two back-to-back arrays of LEDs, to the outermost surfaces of the LEDs, as seen in FIG. 2 or FIG. 7, is about 1.9 mm, thus approximating the thickness dimension of a conventional filament, and facilitating lamp module 32 to be retrofit to an existing reflector 12 designed for a conventional incandescent headlamp.

An MCPCB is usually placed against a heat sink to add in cooling. PCB 14 also bears two thermal heat dissipation pads 18 as is known in the art. Heat dissipation pads 18 can be provided as surface mount technology (SMT) copper pads that are soldered to PCB 14. These structures can be ribbed or formed in some suitable manner to enlarge the surface area and for stiffening. PCB 14 has electrical traces (not shown) to supply power to LEDs 17. PCB 14 has, connected to the electrical traces, an electrical connector 19 to mate with electrical receptacle 102 on driver circuit board 10. Driver circuit board 10 also has input receptacle 101 to make electrical connection with the vehicle chassis electrical supply, which is typically around 9V to 16V, commonly about 12V. Driver circuit board 10 has, as is known in the art, a constant current driver (not shown) to drive LEDs 17 for well controlled lumen output from 11V to 14V.

Base 2 has retaining keys 42 projecting radially outward from outer peripheral surface 44. The peripheral surface 44 acts as a radial locating surface, and peripheral surface 44 is configured for radially fitting into the bore of socket 121 of reflector 12, all in a manner as well known in the art and described hereinabove with regard to the Coushaine U.S. Pat. No. 5,855,430 herein incorporated in its entirety by reference. Locating surface 44 is formed on an outer peripheral surface of partially hollow projection or post 4.

Post 4 projects upward from base 2. Hollow post 4 communicates with base interior cavity 201. An interior of post has one or more grooves defining a first air flow passage 401. Preferably there are two first air flow passages 401 on half of post 4. A portion of post 4 is formed as a removable post cap 500. PCB 14 is clamped to a mounting surface on post 4 by post cap 500 and secured by a fastener 502, such as a screw, extending through a fastener hole (which provides adequate clearance) in PCB 14 and into post 4. On an interior of post cap 500 are formed one or more grooves defining an additional first air flow passage 401, preferably two such first air passages 401. In total there are four first air flow passages 401 on the fully assembled post 4. The first air flow passages 401 direct air principally past LEDs 17 and heat dissipation pads 18 on both sides of PCB 14. Fastener 502 can be formed as a machine screw, self-tapping screw, bolt or the like. Base 2, post 4 and post cap 500 are formed of heat-conductive material, such as metal, e.g. an aluminum. First air channels 401 can be sized relatively compact because post 4 also helps conduct heat away from PCB 14 towards base 2. Referring to FIG. 1, air exiting flow passages 401 exhibits a flow pattern generally as indicated as first air flow F1.

Figure 8:
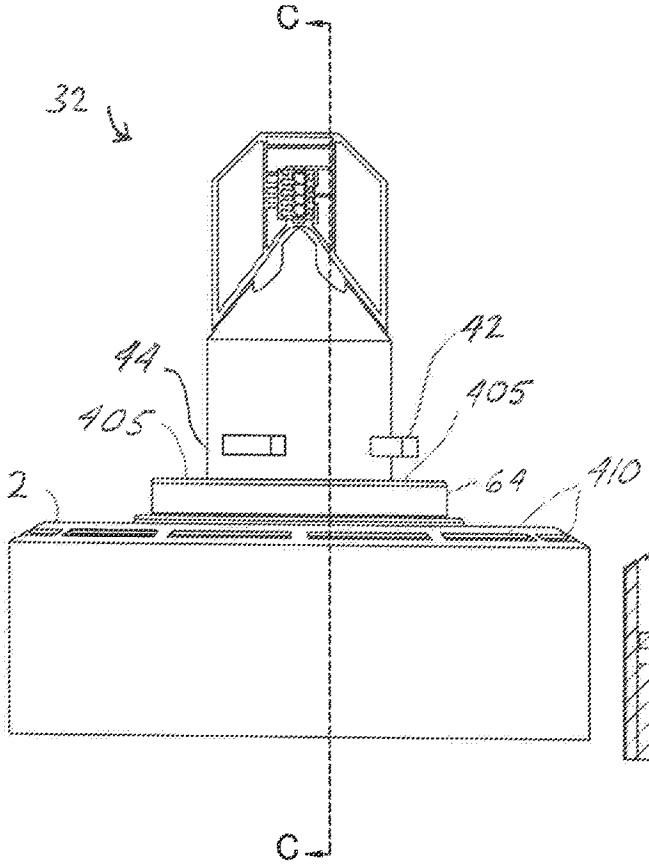
FIG. 8 is a front elevational view of lamp module 32 with section C-C.
Figure 10:
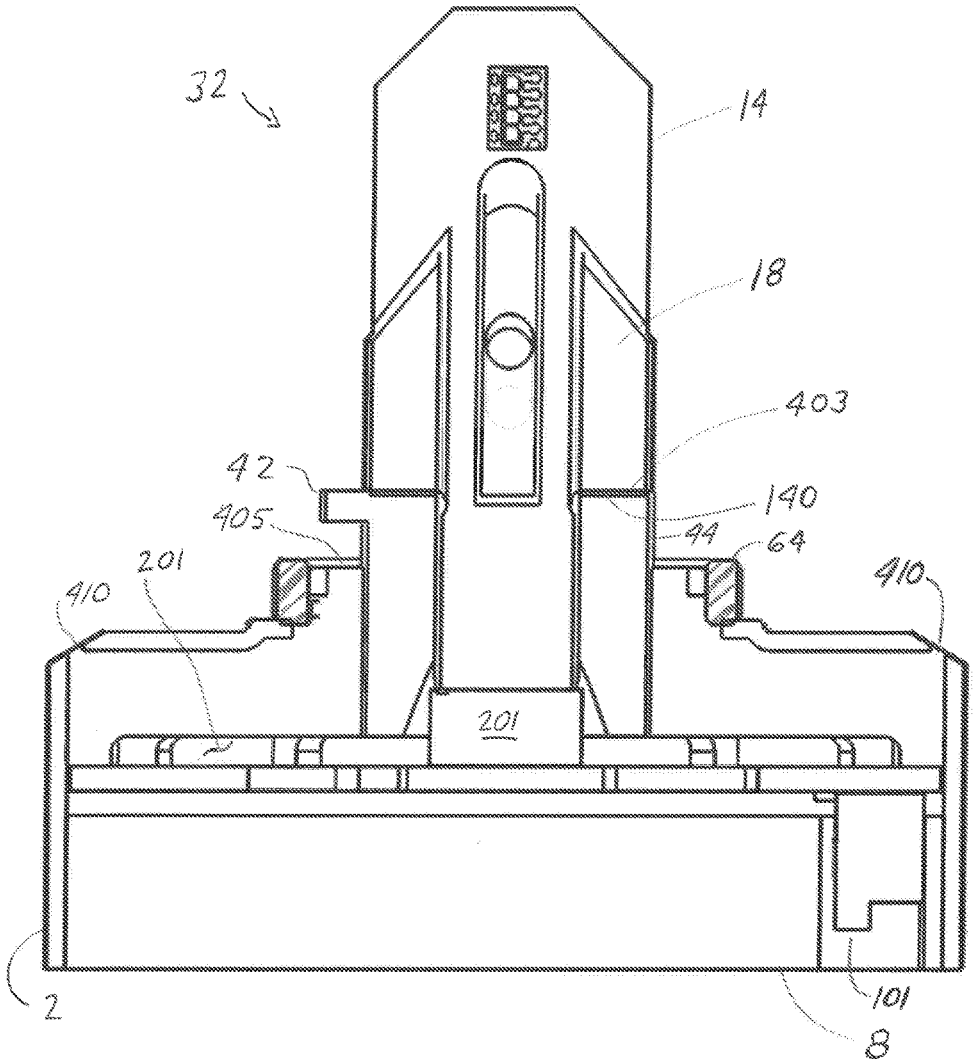
FIG. 10 is partly diagrammatic view of lamp module 32.

Post 4 and base 2 can be manufactured as a one-piece casting (as shown in FIG. 8), such as from a cast aluminum alloy, and then features formed as necessary by secondary machining operations. Alternatively, post 4 and base 2 are formed as two separate parts and then screwed or staked together to form an integral assembly of post 4 and base 2. Further alternatively, a one-piece casting as discussed for post 4 and base 2 could be modified to cast base 2 and post 4 along with post cap 500 as a one-piece casting divided along a centerline into right-side and left-side portions (not shown), such as right- and left-halves, which are then screwed together to sandwich PCB 14.

Surface locating features can be provided on PCB 14 and post 4 in order to accurately position LEDs 14 relative to base 2. The PCB 14 is advantageously positioned against post 4 by having abutment surface 140 formed on an edge of PCB 14 which when assembled contacts datum surface 403 formed on post 4 of base 2. These mating datum surfaces can cooperate with a pin and slot arrangement defined by pin 402 on post 4 cooperating with locator hole 13 in PCB 14. Alternative datum surfaces to a pin and slot are well known to those of skill in the art and could be provided by mating features such as a pin to (not shown) a flat or to two flats.

Figure 6:
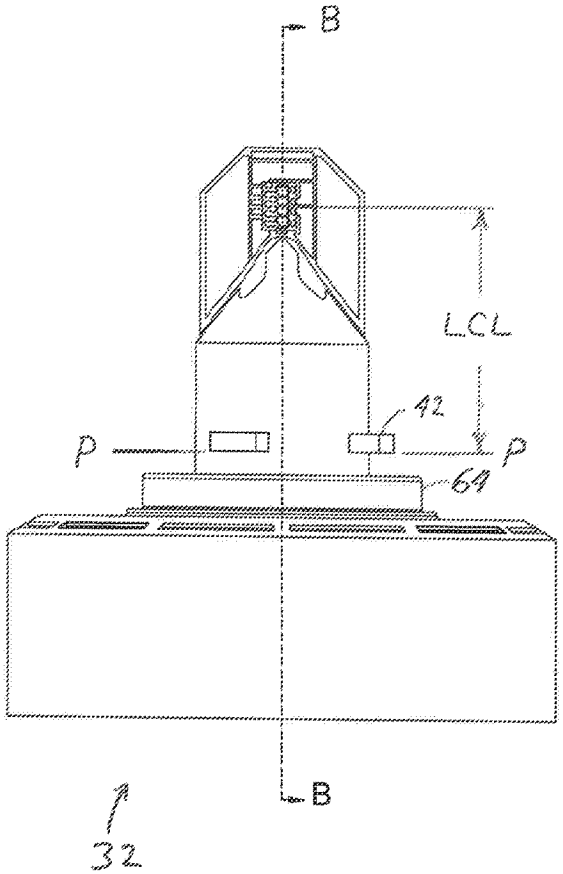
FIG. 6 is a front elevational view of lamp module 32 with section B-B.
Figure 9:
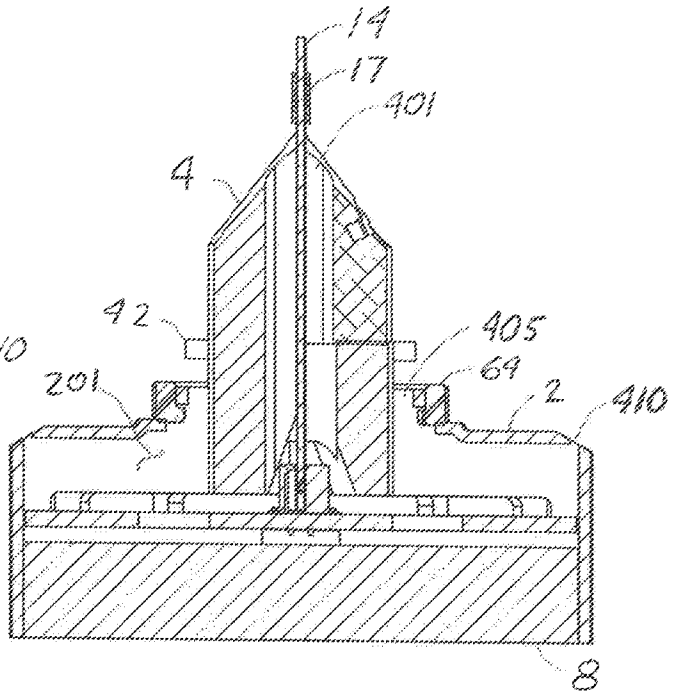
FIG. 9 is a sectional view along C-C of FIG. 8.

Referring to FIGS. 6-9, a cross-section on plane B-B of FIG. 6 is shown at FIG. 7, and a cross-section on plane C-C of FIG. 8 is shown at FIG. 9. FIG. 7 illustrates pin 402 of post 4 disposed in locator key or hole 13.

Referring to FIG. 2 and FIG. 6, base 2 has a mounting flange 42, preferably three such mounting flanges 42 as is conventional in the art, whose undersurfaces 40 define a reference plane P. Reference plane P indicates a mounting plane at which lamp module 32 is retained in socket 121 of reflector 12. The dimension Light Center Length (LCL) is determined in the art from a reference plane P axially to the center of the array of LEDs 17, and in an embodiment hereof can advantageously be controlled to 27.25±0.2 mm such that lamp module 32 serves as an LED substitute for conventional incandescent H11 headlamps in pre-existing conventional reflectors 12 installed in existing vehicle fleets.

Referring to FIGS. 1, 3, 5, 9 and 10, base 2 also has at least one aperture to define a second air flow passage 405. Preferably second air flow passage 405 is formed as a plurality of passages providing plural flow channels, receiving forced air directed by fan 8 through interior cavity 201 and expelling the air along an exterior of post 4. The air outlets of second flow passages 405 are disposed adjacent outer peripheral surface 44 of post 4, and are as well disposed, in an axial direction, below mounting flange structure 42. Referring to FIG. 1, air exiting the second flow passages 405 exhibits a flow pattern generally as indicated as second air flow F2. In an operative condition of lamp module 32 mounted to socket 121 of reflector 12, second air flow passages 405, while they may advantageously be located below a mounting plane P of module 32, do direct air into an interior 122 of reflector 12, see e.g. FIGS. 11, 13 and 14. Gasket 64 is made of resilient material, such as elastomer or silicone, and in assembled position surrounds a transition neck region between heat sink base 2 and post 4 adjacent to post outer peripheral surface 44. As assembled, gasket 64 surrounds second flow passages 405. Gasket 64 has projecting features 65 similar to ribs which can assist in preventing occluding of second flow passages 405.

Referring to FIGS. 1, 3, 5, 9 and 10, base 2 also has at least one aperture to define a third air flow passage 410. Preferably third air flow passage 410 is formed as a plurality of passages providing plural flow channels, receiving forced air directed by fan 8 through interior cavity 201 and expelling the air away from base 2. Third air flow passages 410 are located radially more outward on base 2 than are second air flow passages 405. The air outlets of third flow passages 410 are disposed, in an axial direction, below mounting flange structure 42. The air outlets of third flow passages 410 may advantageously be disposed on a radially outermost region of base 2. Referring to FIG. 1, air exiting the third flow passages 410 exhibits a flow pattern generally as indicated as third air flow F3. In an operative condition of lamp module 32 mounted to socket 121 of reflector 12, third air flow passages 410, are advantageously located well below a mounting plane P of module 32 such that they do not direct air into an interior of reflector 12 but rather direct air rearward of reflector 12 to an exterior region 123 exterior of and behind reflector 12, see e.g. FIGS. 13 and 14.

Figure 12:
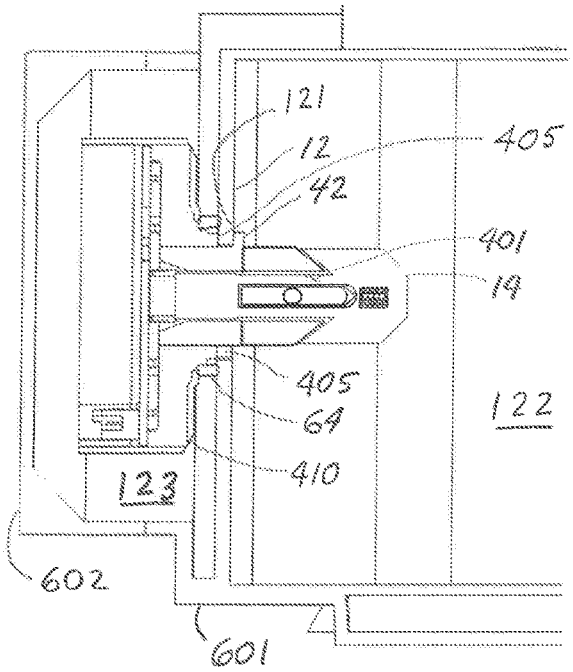
FIG. 12 is a front schematic of lamp module 32 mounted in headlamp 6 showing air passageways 401, 405 and 410.
Figure 11:
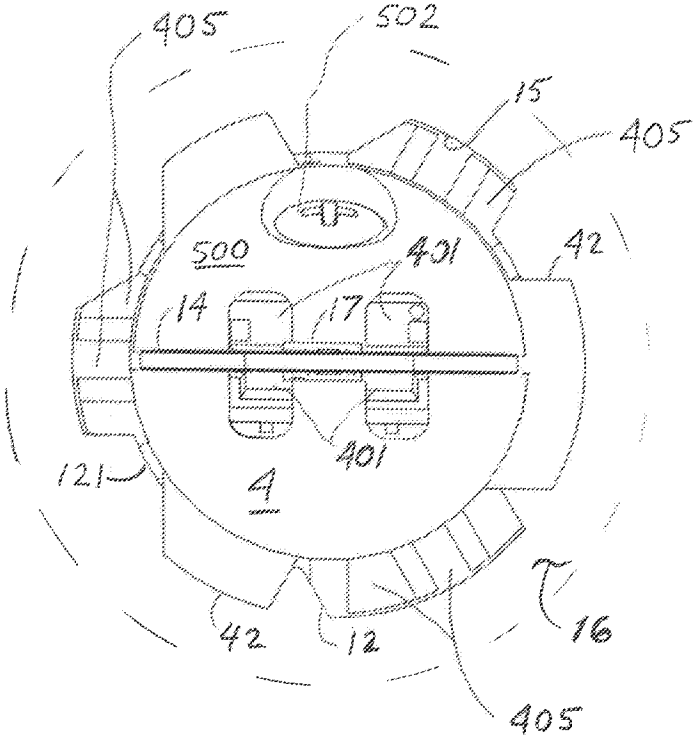
FIG. 11 is a top diagrammatic view of lamp module 32 coupled to reflector 12.

Referring to FIGS. 11-12, FIG. 11 is an interior view within socket 121 of reflector 12 of lamp module 32 having been aligned into reflector 12 by the three retaining keys 42 on base 2 inserted into the three mating, key-receiving slots 15 on reflector 12 and then turned a quarter turn to look it into reflector 12, as is conventional in the art. Along its reflector interior 122 reflector 12 has optical surface 16, shown in fragmentary view. From the direction of viewing in FIG. 11 from reflector interior 122 (FIG. 12), lamp module 32 and its retaining keys 42 was inserted into slots 15 and then rotated counter-clockwise about its central axis onto the lands or ledges adjacent slots 15, as has been previously described hereinabove. Note that in the orientation of lamp module 32 coupled to reflector 12, second air flow passages 405 communicate into interior 122 of reflector 12 through the key openings or slots 15. Thus, second air flow passages 405 permit air to move from an exterior region 123 exterior of reflector 12 towards the front of reflector 12.

Figure 13:
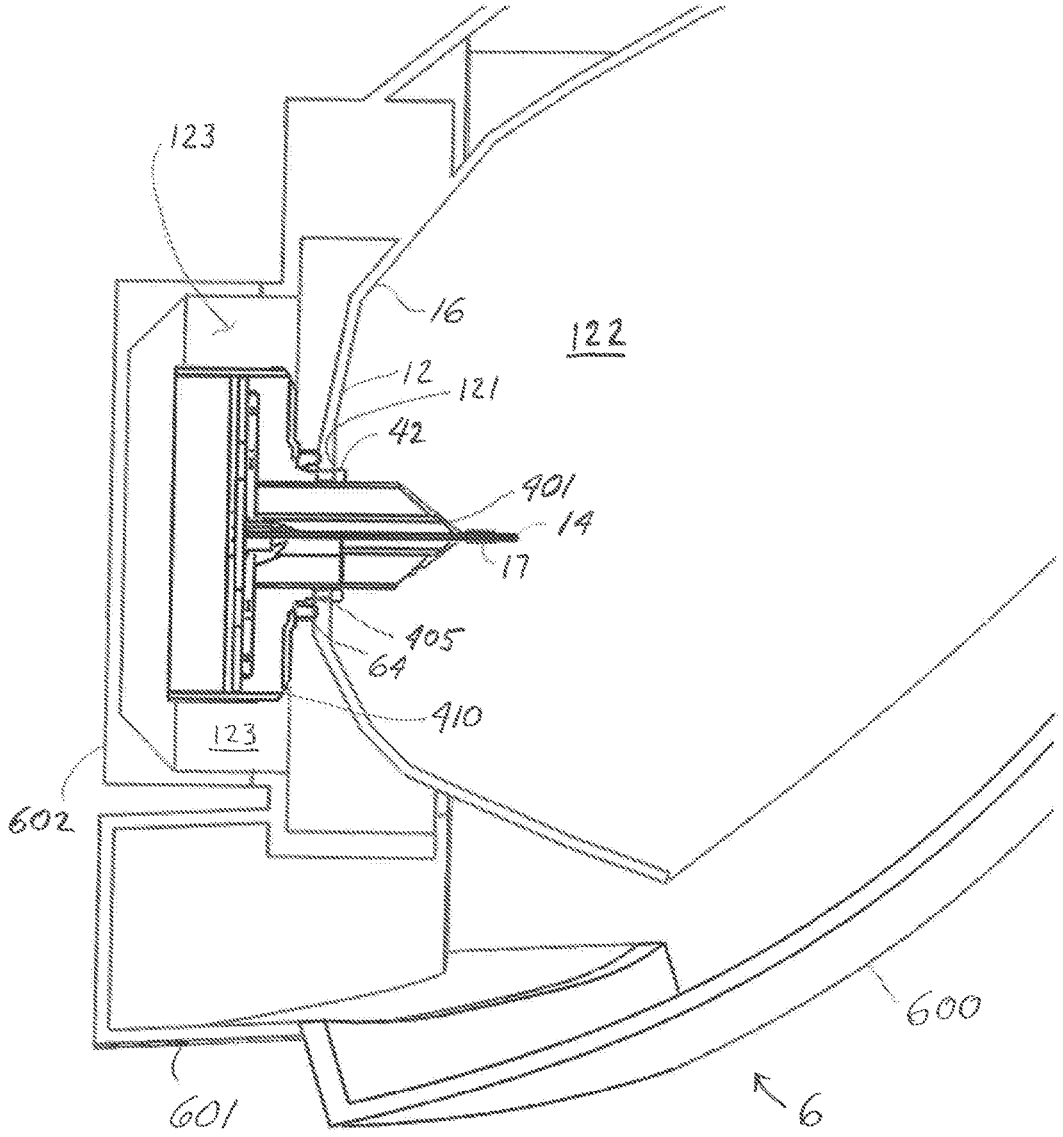
FIG. 13 is a side schematic of lamp module 32 mounted in headlamp 6.
Figure 14:
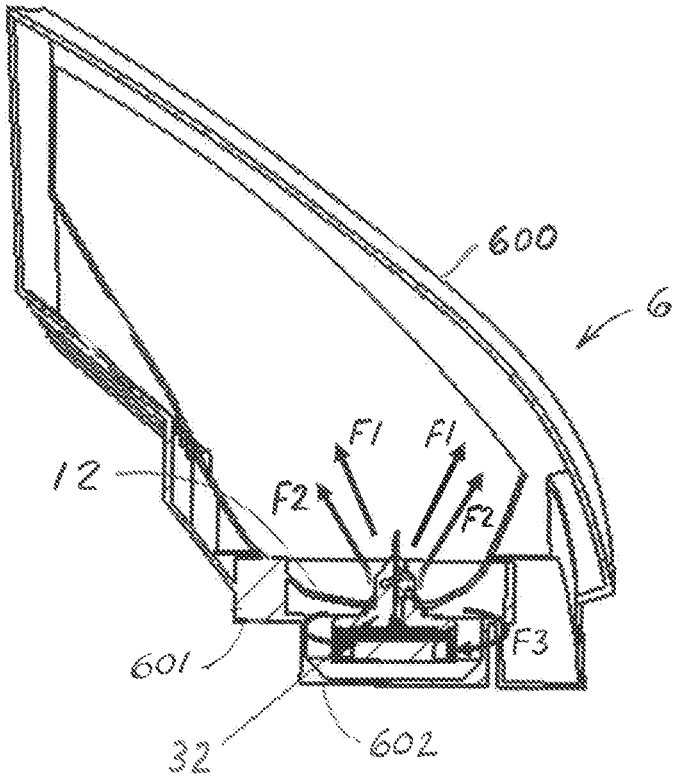
FIG. 14 is a schematic view of lamp module 32 in headlamp 6 showing air flows F1, F2 and F3.

Referring to FIGS. 12-14, in an installed operative position of lamp module 32 in reflector 12, first air passages 401 communicate through post 4 past PCB 14 into reflector interior 122, and second air passages 405 communicate along an outer surface 44 of post 4 into reflector interior 122. The third air passages 410 are directed towards region 123 behind and exterior of reflector 12. Third air passages 410 are also substantially separated by gasket 64, which surrounds second air flow passages 405, from blowing air into an interior of reflector 12. Collectively, air flow passages 401 and air flow passages 405 direct about 30% of the air forced by fan 8 from the back of headlamp 6 to the front of the headlamp. This aspect makes the LED substitute or retrofit lamp module 32 more compatible with a variety of reflectors already installed in vehicles since temperature management of LEDs 17 is then less dependent on the particular geometry of an individual reflector style. Furthermore, this aspect takes advantage of the fact that the front of headlamp 6, such as at headlamp cover lens 600, is generally cooler since it is farther from the hot engine compartment, thus allowing a significant amount of air near lamp module 32 to become cooled and thus preventing air around the heatsink of base 2 from stagnating and becoming too hot to cool module 32 (such as by having insufficient temperature differential from the rear heatsink of base 2 to drive heat transfer). Moreover, this aspect, by directing significant heated air towards cover lens 600, can improve defogging or deicing performance at cover lens 600. This aspect of diving the air flow has the advantage that it prevents the ambient air temperature around LEDs 17 from continually increasing and forming an "oven" around the base heatsink 2 thus reducing the ability to remove heat from the LEDs 17 as the air would become increasingly hotter. Because air is circulated from the back to the front by going through post 4 and the second air passages 405 in base 2, the performance of lamp module 32 is less dependent on the exact design of reflector 12 and makes lamp module 32 more compatible across a wider range of reflector designs and vehicle models. While not being bound to a particular theory, typically once air is moved from the back to the front of the reflector, the path back to fan 8 is long and circuitous, which permits the air to give up its heat to the cooler surface of cover lens 600 before returning to fan 8.

Referring to FIGS. 12-14, headlamp 6 has housing 601 in which reflector 12 is disposed, and housing 601 supports cover lens 600, having a construction as is known in the art. Air flows F1 and F2, resulting from air forced from the back of the headlamp to the front through first air passages 401 and second air passages 405, respectively, eventually returns towards rear cavity 123 exterior of reflector 12 through conventionally-existing internal ducts, cracks and baffles that make headlamp 6 "leaky" inside (i.e., without hermetic barrier between interior and exterior regions of reflector 12) such that the air is again available to be drawn into air inlet 81 of fan 8. FIGS. 12-14 also indicate air flow F3, resulting from air exiting at third air passages 410, is directed in region 123 behind and external to reflector 12.

Again referring to FIGS. 12-14, it may in some cases be desired to couple lamp module 32 permanently or semi-permanently to reflector 12 inside headlamp 6 so that it is not a user-serviceable part in the aftermarket. This can be advantageous if it is desired to offer headlamp 6 as a factory-sealed unit. Headlamp 6 having housing 601 can include an end cover 602 that is firmly attached to housing 601 in overlying relation to lamp module 32 rearward of base 2. End cover 602 could be attached by rivets or welding or other techniques intended to be not readily removable. With end cover 602 secured to headlamp housing 601, exterior region 123 external of reflector 12 is more bounded and the heat sink at the rear region of base 2 somewhat more insulated from the hot engine compartment.

In an operative embodiment of lamp module 32, it drew 16 Watt at 12.8V input to provide a steady state luminous flux of 1250 lm±10% and with fan 8 energized maintained a maximum temperature below 140 degrees C. at LEDs 17.

While a preferred embodiment of the present disclosure has been described, it should be understood that various changes, adaptations and modifications can be made therein without departing from the spirit of the disclosure and the scope of the appended claims. The scope of the disclosure should, therefore, be determined not with reference to the above description, but instead should be determined with reference to the appended claims along with their full scope of equivalents. Furthermore, it should be understood that the appended claims do not necessarily comprise the broadest scope of the disclosure which the applicant is entitled to claim, or the only manner in which the disclosure may be claimed, or that all recited features are necessary.

The following is a non-limiting list of reference numeral used in the specification:

2 base
4 post
6 headlamp assembly

8 fan
10 driver circuit board
12 reflector
13 locator hole in PCB 14
14 printed circuit board
15 slot
16 inner optical surface of reflector 12
17 LEDs
18 heat dissipation pad
19 connector
32 lamp module
42 mounting flange or key
44 outer peripheral surface
64 gasket
65 gasket ribs
81 air inlet of fan
101 input receptacle
102 electrical receptacle
121 socket of reflector 12
122 interior of reflector 12
123 exterior region
140 edge of circuit board 14
201 interior cavity
401 first air passage
402 pin (second datum surface)
403 first datum surface
405 second air passage
410 third air passage
500 post cap
502 screw or fastener
600 cover lens
601 headlamp housing
602 end cap
P mounting plane
F1 first air flow
F2 second air flow
F3 third air flow

What is claimed is:

1. An automotive solid-state lamp module (32), comprising:

a base (2) defining a central post (4) having an outer peripheral surface (44), the post defining an internal first air flow passage (401) in an interior of the post, a circuit board (14) bearing at least one solid-state light source (17);

the post (4) defining a mounting surface for the circuit board (14) bearing the at least one solid-state light source (17);

a mounting flange (42) disposed on the base (2), the mounting flange configured to be coupleable to a lamp-receiving reflector socket (121) of a reflector (12);

the base (2) further defining at least one exterior second air flow passage (405) exteriorly adjacent the post (4), the second air flow passage (405) being oriented to direct air exiting the second air flow passage past the mounting flange (42) and adjacent the post outer peripheral surface (44);

the base (2) further defining a third air flow passage (410) having an air outlet disposed axially rearward of the mounting flange (42) and radially outward from the second air flow passage (405); and an air-moving fan (8) disposed in the base (2) arranged to, when energized, move air to the first, second and third air flow passages (401, 405, 410);

wherein a post interior surface defines a first datum surface (403) and a second datum surface (402), the first datum surface (403) abutting an edge (140) of the circuit board (14) and the second datum surface (402) abutting a locator feature (13) on the circuit board (14).

2. The lamp module (32) of claim 1, further comprising a gasket (64) surrounding the post (4) and disposed in an axial direction away from the mounting flange (42); and wherein the second air flow passage (405) is disposed radially inward of the gasket (64).

3. The lamp module (32) of claim 2, wherein the gasket (64) surrounds the second air flow passage (405).

4. The lamp module (32) of claim 1, wherein the second air flow passage (405) comprises a plurality of passages.

5. The lamp module (32) of claim 3, wherein the second air flow passage (405) comprises a plurality of passages.

6. The lamp module (32) of claim 1, wherein the base (2) is formed of thermally conductive material forming a heat sink.

7. The lamp module (32) of claim 1, wherein the mounting flange (42) comprises a plurality of radially extending keys.

8. An automotive solid-state lamp module (32) adapted to be selectively secured to a reflector (12) having a lamp-receiving socket (121), said lamp module in combination with the reflector (12) disposed in a headlamp housing (601) forming a headlamp assembly (6), said lamp module comprising:

a base (2) defining a central post (4) having an outer peripheral surface (44), the post defining an internal first air flow passage (401) in an interior of the post, a circuit board (14) bearing at least one solid-state light source (17);

the post (4) defining a mounting surface for the circuit board (14) bearing the at least one solid-state light source (17);

a mounting flange (42) disposed on the base (2), the mounting flange configured to be coupleable to the reflector socket (121);

the base (2) further defining at least one exterior second air flow passage (405) exteriorly adjacent the post (4), the second air flow passage (405) being oriented to direct air exiting the second air flow passage past the mounting flange (42) and adjacent the post outer peripheral surface (44);

the base (2) further defining a third air flow passage (410) having an air outlet disposed axially rearward of the mounting flange (42) and radially outward from the second air flow passage (405); and an air-moving fan (8) disposed in the base (2) arranged to, when energized, move air to the first, second and third air flow passages (401, 405, 410); wherein the first air flow passage (401) and the second air flow passage (405) direct air received from the fan (8) into an interior (122) within the reflector (12); and the third air flow passage (410) directs air received from the fan (8) towards an exterior region (123) rearward of the reflector (12).

9. The headlamp assembly of claim 8, further comprises an end cap (602) attached to the headlamp housing (601) rearward of the reflector (12) and in overlying relation to the base (2) of the lamp module (32).

10. A method of cooling a solid-state vehicle lamp module (32) retained in a vehicle headlamp reflector (12), comprising inserting a lamp module (32) having a solid-state light source (17) into a reflector interior (122) of a vehicle headlamp reflector (12) having a lamp-receiving socket (121) configured to receive the lamp module (32), the reflector (12) defining adjacent the socket (121) a plurality of circumferentially disposed slots (15);

latching the lamp module (32) to the headlamp reflector (12);

directing a first flow of air (F1) from an exterior region (123) exterior the reflector (12) through the lamp module (32) and adjacent the solid-state light source (17);

directing a second flow of air (F2) from the exterior region (123) exterior the reflector (12) through the lamp module (32) and through the plurality of slots (15) and thereby into the reflector interior (122); and directing a third flow of air (F3) from the lamp module (32) away from the reflector interior (122) to the exterior region (123) exterior the reflector (12).

11. A method of cooling a solid-state vehicle lamp module (32) retained in a vehicle headlamp reflector (12), comprising inserting a lamp module (32) having a solid-state light source (17) into a reflector interior (122) of a vehicle headlamp reflector (12) having a lamp-receiving socket (121) configured to receive the lamp module (32), the reflector (12) defining adjacent the socket (121) a plurality of circumferentially disposed slots (15);

latching the lamp module (32) to the headlamp reflector (12);

directing a first flow of air (F1) from an exterior region (123) exterior the reflector (12) through the lamp module (32) and adjacent the solid-state light source (17);

directing a second flow of air (F2) from the exterior region (123) exterior the reflector (12) through the lamp module (32) and through the plurality of slots (15) and thereby into the reflector interior (122); and directing a third flow of air (F3) from the lamp module (32) rearward of the reflector (12) thereby bypassing the reflector interior (122).

12. The method of claim 10, further comprising spatially separating the third flow of air (F3) from the second flow of air (F2) by a barrier (64).

13. The method of claim 10, wherein the latching comprises rotating the lamp module (32) relative the plurality of slots (15).

14. The method of claim 10, wherein a principal direction of the second flow of air (F2) is directed laterally displaced from the first flow of air (F1).

* * * * *